United States Patent [19]

Rousseau

[11] Patent Number: 4,903,376

[45] Date of Patent: Feb. 27, 1990

[54] CARD HOLDER

[76] Inventor: Jean-Pierre Rousseau, 96 Rue de Miromesnil, 75008, Paris, France

[21] Appl. No.: 182,693

[22] Filed: Apr. 18, 1988

[51] Int. Cl.[4] ..... B42F 1/00

[52] U.S. Cl. ..... 24/67.9; 24/67.3; 150/137

[58] Field of Search ..... 24/67.9, 67.3, 3 R, 24/3 K, 49 K, 49 C, 49 CC, 499, 543, 546, 343; 150/137; 224/229

[56] References Cited

U.S. PATENT DOCUMENTS

| | | | |
|---|---|---|---|
| 473,835 | 4/1892 | Gould | 24/67.3 |
| 1,193,439 | 8/1916 | Smith | 24/3 K |
| 1,252,906 | 1/1918 | Kestenman | 24/499 |
| 1,381,846 | 6/1921 | Maker et al. | 24/49 C |
| 3,237,326 | 3/1966 | Naffin | 24/67.3 |
| 3,267,546 | 8/1966 | Kraft | 24/67.3 |
| 4,056,139 | 11/1977 | Murt | 150/137 |
| 4,107,823 | 8/1978 | Siesto | 24/3 K |
| 4,706,342 | 11/1987 | Yu | 24/67.3 |

FOREIGN PATENT DOCUMENTS

| | | | |
|---|---|---|---|
| 507060 | 12/1954 | Italy | 24/3 K |
| 0707121 | 5/1966 | Italy | 24/343 |

*Primary Examiner*—Victor N. Sakran

*Attorney, Agent, or Firm*—Wolder, Gross & Bondell

[57] ABSTRACT

An improved card holder comprises a base having opposed first and second ends; a first arm pivotally mounted to and spaced from said first end of said base, biased to pivot away from said base and a second arm overlying said first arm and pivotally mounted to and spaced from said second end of said base, biased to pivot towards said base. The first and second arms are in a parallel, card-retaining relationship to allow cards and similar items to be selectively inserted, maintained, and removed from between the arms.

6 Claims, 1 Drawing Sheet

CARD HOLDER

The present invention relates to a card holder and, in particular, to a new and improved card holder which can carry a plurality of business cards or similar items which may be easily carried by the user.

A recognized part of business formalities includes the exchange of business cards among and between the parties to a meeting, conference or negotiation. Typically, a businessman carries a supply of business cards, often in a flexible plastic or leather case or in a hinged-top metal box, dispensing a card therefrom as required. Alternatively, a supply of cards may be kept in the businessman's wallet, along with the variety of other cards, papers and the like normally placed therein.

Both of these methods of card storage suffer from shortcomings. When in a plastic or leather holder, the cards may be difficult to withdraw, and the holder itself often is of a drab, unappealing nature. In addition, the holder often fails to compensate for different quantities of cards placed therein, thus either permitting the cards to fall out or causing them to be damaged upon removal. When the cards are stored in a box-like dispenser the holder adds unwanted bulk, and provides sharp edges and corners Which may be injurious to clothing, as well as the person. When the cards are stored in a wallet, they may be confused with other card-like items, such as credit cards, and the user must obviously expose his wallet, and its contents, whenever a card is sought to be extracted.

It is a purpose of the present invention to provide a new and improved card holder which provides a secure grip upon the cards loaded therein.

A further purpose is to provide a card holder which adjusts itself to the quantity of cards carried.

Another purpose of the present invention is to provide a card holder having an improved appearance.

Yet a further purpose of the present invention is to provide a card holder which may be easily manufactured and which allows the cards to be easily loaded and removed.

In accordance with the above and other purposes and objects of the present invention, an improved card holder is provided consisting of a pair of parallel arms, at least one of which is pivotally biased with respect to a back or base member such that a clamping action is created between them. A plurality of cards or similar card-like materials may be loaded between the arms, the bias of the arms being overcome as required to allow the insertion of the items. The inserted items are maintained between the arms by the bias, and may be removed from the holder as required, the arms automatically readjusting themselves to accommodate the remaining items. In a particularly preferred embodiment of the invention, the arms are in the form of a pair of plate-like members, each plate being biasly attached to an opposite end of the back member.

Figure 3:
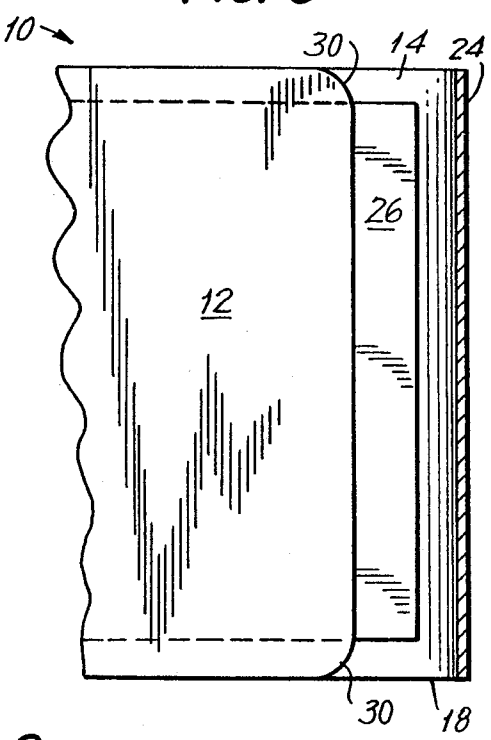
Figure 1:
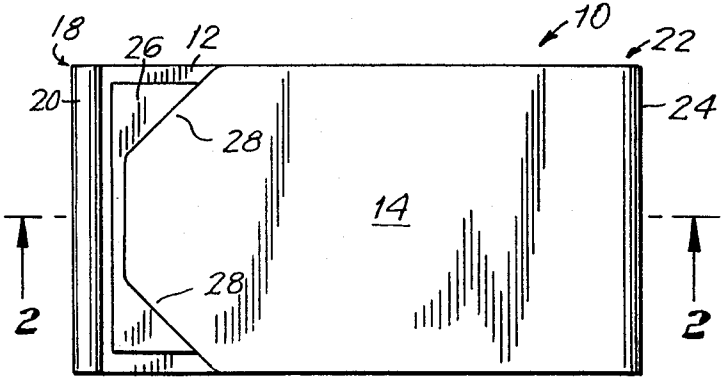
Figure 4:
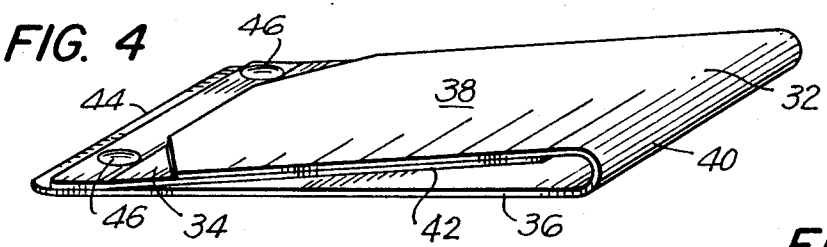
Figure 2:
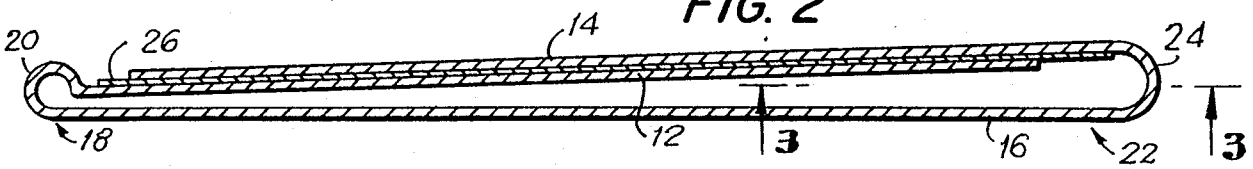

A fuller understanding of the present invention may be achieved upon consideration of the following description of a preferred, but nonetheless illustrative embodiment of the invention when taken in conjunction with the annexed drawings, wherein FIG. 1 is a top plan view of the invention showing a card in place therein;

FIG. 2 a side elevation view, in section, taken along line 2—2 in FIG. 1;

FIG. 3 is a bottom plan view, in partial section, of one end of the , taken along line 3—3 in FIG. 2; and FIG. 4 is a perspective view of an alternative embodiment of the present invention.

Referring initially to FIGS. 1–3, card holder 10 includes a pair of co-acting arm members 12, 14, located in a pair of parallel planes above back or base member 16. In a preferred embodiment, rhe arms and base member are formed of a unitary piece of material, such as brass. In such a case, first arm 12 is joined to a first end portion 18 of back 16 by integral arcuate self-hinge-forming segment 20, while second arm 14 is mounted to second end 22 of back 16 by integral arcuate self-hinge-forming segment 24. In addition to joining the arms to the base, arcuate segments 20, 24 serve as a biasing means for the arms 12, 14. Arcuate segment 20 biases first arm 12 upward in a counterclockwise direction about end 18 as shown in FIG. 2, while arcuate segment 24 biases second arm 14 downward in a counterclockwise direction about end 22. The biasing action of segment 24 is such as to drive arm 14 in a more counterclockwise sense, i.e., towards arm 12, while the biasing action of segment 20 is such as to drive arm 12 in a more counterclockwise sense towards arm 14. With a radius of 3/16 inches for segment 24 and a radius of ⅛ inches for segment 20, the opposed pivoting forces are approximately equal, maintaining the arms in an abutting, essentially parallel relationship, allowing pressure to be exerted upon inserted items across the full surfaces thereof.

When one or more business cards or other substantially flat items 26 are inserted between arms 12, 14, the biasing action of segments 20, 24 can be overcome, arms 12, 14, pivoting apart sufficiently to allow the cards to be inserted therebetween. A plurality of cards may be inserted, the arms 12, 14 pivoting apart as required to allow the cards to be inserted. The biasing action of segments 20 and 24 attempts to minimize the space between the arms 12, 14, thus applying a pair of forces across the entire faces of the inserted cards, maintaining them in position beween the arms. When it is desired to remove a card, however, the card may be slid out in a plane parallel to the planes of the arms, the arms immediately readjusting themselves to firmly embrace the remaining cards.

In order to facilitate the insertion and alignment of the cards 26 within the holder, upper arm 14, which is dimensioned in plan to be slightly larger than the size in plan of the cards for which usage is intended, may have truncated corners 28 at its distal end to allow the corners of cards 26 to be exposed, thus facilitating card insertion and removal. Lower arm 12 may be provided with rounded corners 30. Such truncation and rounding of the corners 28, 30 removes otherwise sharp corners which could serve as a source of injury or clothing damage.

The total thickness of cards which can be held by the holder is dependent on the extent of parallel pivot allowed by arcuate segment 24. The height of segment 20 biasing arm 12 must hold arm 12 sufficiently above back member 16 to allow counterclockwise travel of arm 12, while the height of segment 24 biasing arm 14 must hold arm 14 sufficiently above base 16 to accommodate a reasonable total thickness of inserted cards. With the segment radii stated above, a 270 degree arc for segment 20 and a 180 degree arc for segment 24 results in appropriate positioning of the pivot points. By appropriate sizing, the thickness to be accommodated can be adjusted. This may be necessary, for example, if the holder is to be used for thicker items, such as credit cards.

As shown in FIG. 4, the holder may be alternatively formed of a pair of members 32 and 34; Member 32 defines a base 36 as well as top arm 38 joined to base 36 by arcuate segment 40 while member 34 includes second arm portion 42 biased counterclockwise as shown in the Figures with respect to mounting portion 44. Members 32 and 34 may be formed of brass or similar material and are joined together by any appropriate means, such as rivets 46. As in the previous embodiment, arms 38 and 42 maintain a parallel relationship as cards or similar planar items are inserted therebetween, the respective biasing of the arms exerting a force across the surfaces of the inserted items to maintain them in place.

It is to be recognized by those skilled in the art, that variations and modifications of the invention as disclosed and described herein may be accomplished. The scope of the present invention, therefore, is to be measured by the annexed claims.

I claim:

1. A holder for card-like items, comprising a generally planar base having first and second opposed ends; a solid, planar arm; means supporting said first arm above said base and pivotally connecting said first arm to said first end of said base; a second solid, planar arm overlying said first arm, said arms each dimensioned in plan to be substantially equal in size to the card-like item; and means supporting said second arm in said overlying relationship and pivotally connecting said second arm to said second end of said base; said first and second arm pivot means being biased to urge said first and second arms together in an abutting, parallel orientation such that a card-like item inserted between said first and second arms pivots both of said arms apart whereby the item is retained by the opposed, parallel faces of said arms therebetween.

2. The card holder of claim 1 wherein said support and pivot means are in the form of self-hinges integral with said base.

3. The card holder of claim 2, wherein said base and first and second arms are formed from a unitary piece of material.

4. The card holder of claim 3 wherein said self-hinges are in the form of arcuate segments of said unitary piece of material.

5. The card holder of claim 1, wherein at least one of said planar sheets has truncated corners at its distal end.

6. The card holder of claim 1, wherein said base and said second arm are formed from a first piece of material and said second arm is formed of a second piece of material.

* * * * *